US008287351B2

(12) United States Patent
Boykin et al.

(10) Patent No.: US 8,287,351 B2
(45) Date of Patent: Oct. 16, 2012

(54) SYSTEM AND METHOD FOR A TERMINAL-BASED LOTTERY GAME WITH SUBSEQUENT INTERACTIVE COMPONENT

(75) Inventors: Charles M. Boykin, Alpharetta, GA (US); Brian Bateson, West Yorkshire (GB)

(73) Assignee: Scientific Games International, Inc., Newark, DE (US)

( * ) Notice: Subject to any disclaimer, the term of this patent is extended or adjusted under 35 U.S.C. 154(b) by 969 days.

(21) Appl. No.: 12/189,318

(22) Filed: Aug. 11, 2008

(65) Prior Publication Data

US 2009/0061992 A1 Mar. 5, 2009

Related U.S. Application Data

(60) Provisional application No. 60/968,724, filed on Aug. 29, 2007.

(51) Int. Cl.
*A63F 9/24* (2006.01)

(52) U.S. Cl. ..... 463/17; 463/18; 463/19; 463/25; 463/26; 463/42; 273/138.1; 273/139; 273/269; 705/14.14; 705/16; 705/73

(58) Field of Classification Search ..... 463/17, 463/18, 19, 25, 26, 42; 273/138.1, 139, 269; 705/14.14, 16, 73
See application file for complete search history.

(56) References Cited

U.S. PATENT DOCUMENTS

| | | | | |
|---|---|---|---|---|
| 5,628,684 | A * | 5/1997 | Bouedec | 463/17 |
| 5,651,735 | A | 7/1997 | Baba | |
| 5,772,511 | A * | 6/1998 | Smeltzer | 463/17 |
| 5,791,990 | A * | 8/1998 | Schroeder et al. | 463/17 |
| 6,168,521 | B1 * | 1/2001 | Luciano et al. | 463/18 |
| 6,203,011 | B1 | 3/2001 | Nulph | |
| 6,358,151 | B1 * | 3/2002 | Enzminger et al. | 463/43 |
| 6,398,644 | B1 * | 6/2002 | Perrie et al. | 463/18 |
| 6,475,085 | B2 * | 11/2002 | Moody | 463/17 |
| 6,588,747 | B1 * | 7/2003 | Seelig | 273/138.1 |
| 6,830,514 | B2 | 12/2004 | Meyer et al. | |
| 7,052,394 | B2 * | 5/2006 | Walker et al. | 463/17 |
| 7,213,811 | B2 * | 5/2007 | Bozeman | 273/139 |
| 7,306,519 | B2 * | 12/2007 | Baerlocher | 463/18 |
| 7,470,186 | B2 * | 12/2008 | Cannon | 463/18 |
| 7,553,230 | B2 * | 6/2009 | Cannon | 463/18 |
| 7,654,529 | B2 * | 2/2010 | Rogers | 273/139 |
| 7,666,082 | B2 * | 2/2010 | Kane et al. | 463/17 |
| 7,766,739 | B2 * | 8/2010 | Kane et al. | 463/17 |

(Continued)

FOREIGN PATENT DOCUMENTS

EP 1463005 A1 * 9/2004

OTHER PUBLICATIONS

International Search Report and Written Opinion, Nov. 26, 2008.

*Primary Examiner* — David L Lewis
*Assistant Examiner* — Chase Leichliter
(74) *Attorney, Agent, or Firm* — Dority & Manning, P.A.

(57) ABSTRACT

A lottery game system and methodology incorporates a terminal-based game component and a subsequent interactive-based game component. A player is provided access and is entitled to participation in the interactive-based game component as a function of a winning outcome in the terminal-based game component. The interactive-based game component may incorporate a wagering function.

23 Claims, 4 Drawing Sheets

U.S. PATENT DOCUMENTS

| | | | | |
|---|---|---|---|---|
| 7,815,502 | B2 * | 10/2010 | Hardy et al. | 463/16 |
| 7,819,747 | B2 * | 10/2010 | Kane et al. | 463/29 |
| 8,025,567 | B2 * | 9/2011 | Kane et al. | 463/29 |
| 8,033,905 | B2 * | 10/2011 | Irwin et al. | 463/17 |
| 8,047,907 | B2 * | 11/2011 | Kane et al. | 463/16 |
| 2003/0045340 | A1 | 3/2003 | Roberts | |
| 2004/0133472 | A1 * | 7/2004 | Leason et al. | 705/14 |
| 2004/0204222 | A1 * | 10/2004 | Roberts | 463/17 |
| 2004/0229677 | A1 * | 11/2004 | Gray et al. | 463/17 |
| 2005/0059464 | A1 | 3/2005 | Bozeman | |
| 2005/0096117 | A1 * | 5/2005 | Katz et al. | 463/17 |
| 2006/0160624 | A1 | 7/2006 | Slomiany et al. | |
| 2006/0172793 | A1 * | 8/2006 | Desposito | 463/17 |
| 2006/0172799 | A1 * | 8/2006 | Kane et al. | 463/25 |
| 2006/0287051 | A1 | 12/2006 | Katz et al. | |
| 2007/0117611 | A1 * | 5/2007 | Dodge | 463/18 |
| 2007/0129144 | A1 | 6/2007 | Katz et al. | |

* cited by examiner

24

PICK 4 HI-LO LOTTERY

3 PLAYS: $1 PER PLAY
PICK 4 FOR EACH PLAY 1 match wins Free Ticket; 2 matches wins $50
3 matches wins $500; 4 matches $10,000

| | | |
|---|---|---|
| [1] [2] [3] [4] [5] [6] [7] [8] [9] | [1] [2] [3] [4] [5] [6] [7] [8] [9] | [1] [2] [3] [4] [5] [6] [7] [8] [9] |
| [10] [11] [12] [13] [14] [15] [16] | [10] [11] [12] [13] [14] [15] [16] | [10] [11] [12] [13] [14] [15] [16] |
| [17] [18] [19] [20] [21] [22] [23] | [17] [18] [19] [20] [21] [22] [23] | [17] [18] [19] [20] [21] [22] [23] |
| [24] [25] [26] [27] [28] [29] [30] | [24] [25] [26] [27] [28] [29] [30] | [24] [25] [26] [27] [28] [29] [30] |
| [31] [32] [33] [34] [35] [36] [37] | [31] [32] [33] [34] [35] [36] [37] | [31] [32] [33] [34] [35] [36] [37] |
| [38] [39] [40] [41] [42] [43] [44] | [38] [39] [40] [41] [42] [43] [44] | [38] [39] [40] [41] [42] [43] [44] |
| [45] [46] [47] [48] [49] [50] | [45] [46] [47] [48] [49] [50] | [45] [46] [47] [48] [49] [50] |
| [ ] Quick-Pick | [ ] Quick-Pick | [ ] Quick-Pick |

*STATE LOTTERY COMMISSION*

Fig. 1

26

*STATE LOTTERY COMMISSION*

PICK 4 HI-LO LOTTERY

Date: 01/01/2007

Game Numbers
4 27 10 24

Terminal ID: XY001

Your Numbers
Matches are highlighted

| | | | | | |
|---|---|---|---|---|---|
| Play 1: | 5 | 25 | 33 | 18 | No matches |
| Play 2: | 3 | 22 | 10 | 6 | One (1) match; wins Free Ticket |
| Play 3: | 27 | 41 | 4 | 10 | Three (3) matches; wins $500 |

Congratulations! Two of your Plays have one or more matching numbers. Please log on to http://123.456.78.01 for HI-LO Bonus round.

Your Access Code is: HLL456890

Fig. 2

| Matches | Base Prize | Hi-Lo Guesses | Min. Prize | Max Prize |
|---|---|---|---|---|
| 6 | $2,000,000 | 4 | $125,000 | $32,000,000 |
| 5 | $20,000 | 3 | $2,5000 | $160,000 |
| 4 | $300 | 2 | $75 | $1,200 |
| 3 | $16 | 1 | $16 | $32 |
| 2 | $1 | 1 | $1 | $2 |
| 1 | 1 Free Ticket | 1 | 1 Free Ticket | 2 Free Tickets |

:Each Play consists of 6 numbers from 1 to 90
:Terminal randomly selects 6 lottery numbers from 1 to 90

SYSTEM AND METHOD FOR A TERMINAL-BASED LOTTERY GAME WITH SUBSEQUENT INTERACTIVE COMPONENT

PRIORITY CLAIM

The present application claims priority to U.S. Provisional Application Ser. No. 60/968,724, filed Aug. 29, 2007.

FIELD OF THE INVENTION

The present invention relates to game based transactions, and more particularly to a multi-component lottery game.

BACKGROUND OF THE INVENTION

Various well-known types of lottery games allow a player to select one or more groups of numbers, symbols, and the like, to match with a group of numbers randomly generated by the gaming administrator or operator. For example, lottery games referred to as "Pick-3" are offered in which a player selects three numbers to match identically with a set of three numbers generated by the gaming administrator at a later drawing time. Modifications and versions of this game are well known.

The payout for these games is typically a function of the number of matching numbers selected by the player compared to the total set of random numbers generated by the gaming administrator. Generally, the size of the payout for a winning play must be balanced with the quantity of numbers the player must match to produce a winning outcome. For example, if a high payout is offered, the game generally requires the player to match five or more numbers. This type of game, however, typically produces few winners and, thus, may cause players to lose interest in the game.

If the gaming administrator wishes to produce winners more frequently, it may reduce the quantity of numbers a player must match for a winning outcome. For instance, a match of 3 or more numbers could result in a winning outcome. However, the payout amount for a winning outcome is also reduced accordingly. The lower payout amount may also cause players to lose interest in the game.

Interactive games are also known in the art wherein players interact with the gaming authority over a communications network (such as the Internet or a telephone network). For example, a player may purchase a ticket directly from the gaming authority via the Internet and select certain criteria related to the game from a set of different options, such as the numbers the player wishes to play, or the time the ticket is to be activated. Direct interactive games, however, also have certain drawbacks. For example, such games are not popular with lottery ticket retailers because he retailer is unnecessary to initiate or play the game and is thus bypassed by the player. This can significantly reduce customer traffic in the retailer's establishment. Interactive games also suffer the disadvantage of not having an effective method to distribute or award prizes through the retailer. Also, such games often require the player to purchase the ticket with a credit card, which is not legal in all venues.

The present invention relates to a system and method for a two-component lottery game that merges the benefits of terminal or retailer based systems and player interactive systems.

SUMMARY OF THE INVENTION

Objects and advantages of the invention will be set forth in the following description, or may be obvious from the description, or may be learned through practice of the invention. It is intended that the invention include modifications and variations to the systems and method embodiments described herein.

The present invention relates to a system and related method for providing a dual-component lottery game. The game is initiated at a point of sale site, such as a lottery terminal at a retail establishment. The point of sale sites may include any number of lottery terminals networked into the lottery system. The first component of the game may include any game that requires the player to select a set of values, such as numbers, symbols, and the like, from a defined range of the values. Alternatively, the player may accept a random set of the values generated by the lottery terminal. In a typical scenario, this game may involve a pick-three, pick-four, pick-five, and the like, type of game wherein for each play purchased by the player, the player chooses the appropriate set of numbers from a defined field, such as three, four, or five numbers from a larger field of numbers.

The player's selection can be input into the lottery system at the purchase site. For example, the player's selection may be indicated on a player slip that is filled out by the player and subsequently read and recorded by the lottery terminal. The terminal, in turn, may generate a random set of lottery or "game" numbers. For example, if the game is a pick-four type of game, the terminal will generate a set of four random game numbers from the defined field. For each play purchased by the player and at the point of purchase, the player's selection is compared to the randomly selected game numbers to determine if any matches exist. This process may be done by the player with subsequent verification by the terminal, or may be done automatically by the terminal. A match in any of the plays will generate a base prize. The winning outcome is recorded and stored by the lottery system and, depending on the nature of a subsequent interactive-based game component, the player may collect the prize immediately from the retailer, or may claim the prize at a later date by any means established by the game administrator. The terminal desirably is configured to print a lottery receipt ticket indicating the player's selections for each play, the randomly generated lottery game numbers, and any winning outcomes.

In particular embodiments, the initial terminal-based component of the game is purchased, played, and completed at the point of sale so that the player has essentially immediate feedback at the point of sale.

A winning outcome in any play purchased by the player can provide the player with the opportunity to enter a second component of the game, namely an interactive component that involves the player communicating with the gaming administrator via any suitable communications network, such as the internet, telephone system, wide-area network (WAN), local area network (LAN), and the like. Instructions for initiating this communication at a later time are provided to the player with notification of a winning outcome in any of the lottery terminal based plays. These instructions may be provided, for example, in the receipt lottery ticket printed at the lottery terminal. The instructions may provide the player, for example, with an internet address and access code so that the player may initiate the second component of the game with the gaming administrator at a later time. This time may be limited by the gaming authority, with appropriate warning provided to the player with the instructions. For example, the player may initiate the second component of the game any time within thirty days from the initial terminal-based game.

The interactive component game may take on any manner or form that involves interactive communication between the gaming authority host computer and the player via a remote access site. A typical access site could be the player's home personal computer, or any site where the player has access to the internet or other communications network.

An embodiment of the interactive component game may be a "HI-LO" game that is described in greater detail below.

The present game system and methodology has unique advantages. The game is initiated by the player and paid for at a retail establishment. This encourages retailers to adopt and promote the game. The game offers the player a "bonus" for any initial winning combination wherein the player has a chance to significantly increase the award amount. This bonus is played as an interactive game, which will have great appeal to a certain body of players. Because the purchase of the interactive game is a component of the player's initial purchase at the retail establishment, the gaming authority is not burdened with collecting and controlling remote payments, such as credit card payments via the internet, or the like. The gaming authority is able to maintain strict control of the interactive component of the game by way of individual access codes provided to players for a winning combination. The access codes provide the player with limited access to the lottery system for the sole purpose of completing the interactive game component.

Other objects and advantages of the method and system of the present invention may become apparent to those skilled in the art through practice of the invention.

BRIEF DESCRIPTION OF THE DRAWINGS

FIG. 1 is a front plan view of a hypothetical player slip usable in certain embodiments of the invention.

FIG. 2 is a front plan view of a lottery ticket or receipt that may function as a component of certain embodiments of the invention.

DETAILED DESCRIPTION

Reference will now be made to one or more embodiments of the system and methodology of the invention as illustrated in the figures. It should be appreciated that each embodiment is presented by way of explanation of aspects of the invention, and is not meant as a limitation of the invention. For example, features illustrated or described as part of one embodiment may be used with another embodiment to yield still a further embodiment. It is intended that the invention include these and other modifications that come within the scope and spirit of the invention.

Figures 3, 4:
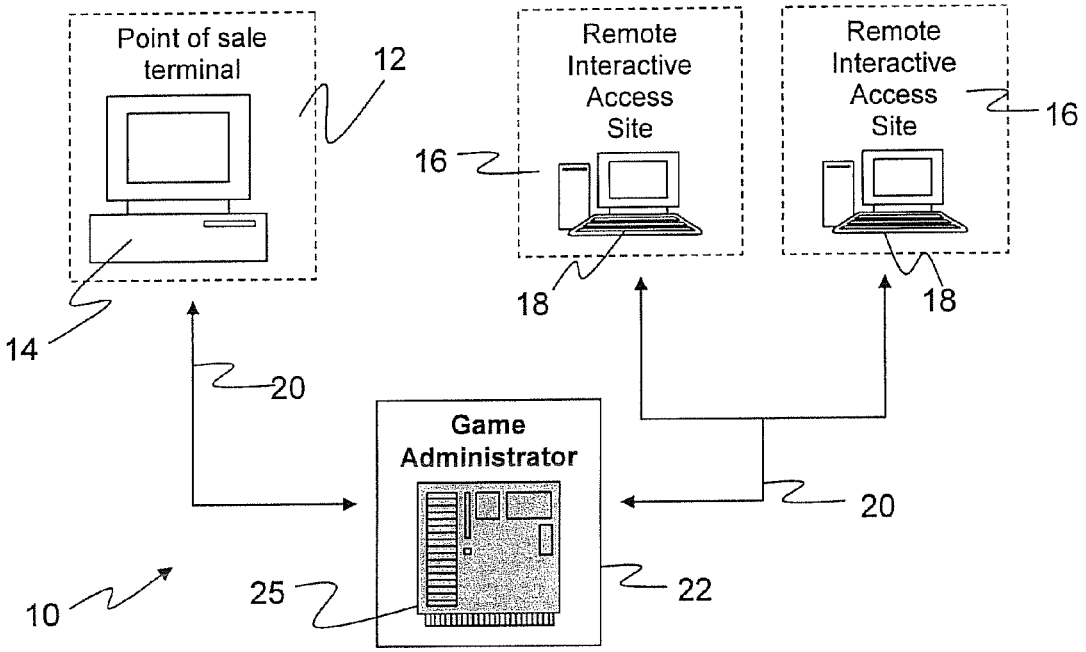
FIG. 3 is a schematic line drawing illustrating conceptual aspects of a system and methodology according to the invention.
FIG. 4 is a view of an instruction chart that may be used for a component of the game according to the invention.

FIG. 3 illustrates a basic conceptual implementation of a system 10 for administering the lottery game. In FIG. 3, the system 10 includes a point of sale site 12 where a player initiates play of the lottery game. This point of sale site may be any one of a number of interconnected lottery terminals 14. FIG. 3 illustrates a single lottery terminal 14. However, it should be readily appreciated that the system 10 may include a vast number of terminal units 14 operatively coupled to a lottery network. This network may, in turn, be in communication with the game administrator 22, and particularly with the administrator's host computer 25 via any suitable communications network 20. This communication network 20 may be, for example, the internet, a wide area network (WAN), a local area network (LAN), a telephone system, and so forth. In a particular embodiment, the lottery network may include a state lottery system operating within an individual state or region of states, wherein the lottery terminal units 14 are interconnected to the game administrator 22 and host computer 25 directly or through an intermediary network for tracking, administration, and coordination of the state lottery system, including control of issued tickets, prizes, drawn numbers, amounts waged, and so forth.

It should readily appreciated that the communications network 20 illustrated in FIG. 3 is meant to encompass any suitable communications architecture that provides the point of sale terminals 14 with the ability to communicate and interact with the lottery game administrator 22.

The point of sale terminals 14 may include any conventional feature known to those skilled in the art related to lottery terminals. The terminal 14 includes features and functionality to allow a player or retail clerk to enter the information required to participate in the lottery game. An exemplary terminal 14 includes a housing, one or more input devices, which may be a control panel having input keys, a display, a value input device such as a card reader, a play slip or ticket reader, and a ticket printer. The play slip reader is typically configured to read user selection marks, bar codes, magnetically stored information, or any other desired input information. Control panel input keys allow the player or retail clerk to select the game to be played, input the value to be wagered, manually enter selected lottery characters, and input any other information necessary to play the lottery game. The terminal preferably includes a display which may be an LCD, a CRT, or touch-screen capable of receiving and displaying information related to the game. The value input device may include any device that can accept value or a wager from a customer, such as a card reader or an optical currency collector. The value input device may be integrated with external devices, such as a cash register or other retail terminals, to exchange information necessary to receive and record the wagering transaction. The lottery ticket printer may be used to print or otherwise encode lottery tickets with information selected or required to play the lottery game. The printer may provide lottery tickets that reflect a player's selection, or complete lottery slips if the selection was generated automatically by the terminal.

It should be readily appreciated that the lottery terminals 14 are not meant as a limitation of the invention, and encompass any configuration of features and functionality to allow initiation and playing of a terminal-based lottery game.

The game administrator host computer 25 may be a single networked computer, or a series of interconnected computers having access to the lottery system or network via any suitable networking system. Generally, such computers 25 are configured to manage, execute, and control the individual lottery terminals 14 and the routines used to play various lottery games. The host computer 25 may include memory for storing lottery programs and routines, a microprocessor for executing stored routines, random access memory (RAM), and an input/output (I/O) bus. In addition, the host computer 25 may be in communication with any manner of external device, including external databases. Such databases may provide a data repository for the storage and correlation of information gathered from the individual lottery terminals 14 relating to the individual terminals, such as terminal specific information like the machine ID, sales establishment, location, and ticket-specific information.

It should be readily appreciated that the host computer 25 may encompass any configuration of hardware and software applications necessary to manage, execute, and control administration of the lottery game.

FIG. 1 illustrates an exemplary hypothetical play slip 24 that may be used by a player to input their selection. The play slip 24 desirably includes informational, instructional, or security information such as a bar code, award details, authentication numbers, and the like. It should be appreciated that different ticket types and formats may be used depending on the theme, format, and rules of the game. The slip 24 may be printed with any optically readable material such as ink, or encoded with data on a magnetic material or smart chip. An exemplary slip 24 may include a title indicative of the associated game, a set of directions or instructions, and a plurality of game specific selections that allow the player to define how many numbers to play and the exact amount to be wagered. The play slip 24 may provide the player with a "quick-pick" option wherein the player accepts a selection that is automatically and randomly generated by the lottery terminal unit or host computer. The slip 24 typically includes a manual selection area arranged to allow the player to select from a predefined field or list of numbers, letters, or other characters. In this manner, the player or retail clerk can fill-out, code, or otherwise record the information necessary to participate in a specific game at the lottery terminal.

With the play slip 24 illustrated in FIG. 1, the lottery terminal-based game involves a pick-four game wherein a player can purchase one or more plays at a defined purchase price (e.g., $1.00 per play). For example, slip 24 provides the player with the option to purchase three separate plays. For each play, the player selects four numbers from numbers 1 through 50 by marking or otherwise indicating the selected numbers on the play slip 24. Alternatively, the player may select the quick-pick option wherein the lottery terminal will generate four random numbers for the player. The slip 24 also indicates the awards for the number of matches for each play. For example, one match wins a free ticket; two matches wins $50.00; three matches winds $500.00; and four matches wins $10,000.00. It should be appreciated that these award amounts are meant merely for illustration and discussion purposes, and that any award and payout scheme may be utilized.

It should also be appreciated that the player selection need not be made via a card, slip, or other tangible readable device, but may involve direct interface of the player with the terminal 14. For example, the player may be provided access with an input device, such as a keyboard, wherein the player selections are directly inputted to the terminal.

The terminal 14 includes a play slip reader, as discussed, that is configured to read and record the player selections. The terminal 14 generates any manner of suitable ticket, such as the exemplary ticket 26 illustrated in FIG. 2, that indicates the number of plays purchased by the player, and the player's selection for each play.

Depending on the type of game, upon receipt of the play slip 24, the lottery terminal 14 may generate a set of random lottery numbers from the defined field of numbers. For example, in the game illustrated in FIGS. 1 and 2, the defined field is the numbers from 1 to 50. The lottery terminal 14 generates four random numbers from this field and designates these numbers as the lottery "game numbers." In the lottery ticket 26 in FIG. 2, these numbers are indicated as the game numbers 4, 27, 10, and 24. It should be appreciated that the randomly generated numbers may be generated at the terminal 14, or at the host computer 24 and communicated to the terminal 14.

The terminal 14 may compare the numbers designated or selected by the player for each of the plays 1, 2, and 3 with the randomly generated game numbers, and desirably indicates any matches on the ticket 26. This indication may be by any suitable means, such as highlighting or otherwise marking the matched numbers. Referring to the ticket 26 in FIG. 2, play 1 had no matches, play 2 had one match, play 3 had three matches. Desirably, the ticket 26 also indicates a base prize for any winning play in accordance with the base prizes indicated on the initial player slip 24. For example, in play 1, no prize is awarded since no matches were found. In play 2, the prize amount for one match (a Free Ticket) is indicated. Likewise, the cash prize amount for three matches is indicated for play 3.

The player may collect the base prize amount from the game administrator by any suitable means established by the administrator. The base prize amount may be a guaranteed amount, or may function as a wager amount in the subsequent interactive game, as discussed below.

As mentioned, any winning combination in one of the terminal-based lottery plays entitles the player to participation in a subsequent interactive game component. The player is provided with instructions on the ticket 26 as to how to initiate this interactive component. For example, in FIG. 26, the player is provided with an Internet address and access code that allows the player to initiate communication with the host computer 24 from any manner of suitable remote interactive access sites 16. Referring to FIG. 3, such access sites 16 may be, for example, the player's home computer, or any computer or terminal that provides the player with Internet access. In alternative embodiments, the player may have access to the host computer 24 via a secure telephone communications system, or any other suitable networking communication system. The time in which the player may initiate the second component of the game may be limited by the game administrator and indicated on the ticket 26. For example, ticket 26 may specify that the interactive game must be initiated within thirty days from the date of the ticket.

The interactive component of the game may be any game that utilizes the results of the terminal-based game component as a factor or variable. In the illustrated embodiment, the interactive-based game component is a "HI-LO" game wherein the number of matches in a player's initial play determines the restraints of the game. Once the player has logged onto the administrator host site, instructions and a payout or other award scheme are provided to the player.

FIG. 4 is a chart that illustrates constraints of a HI-LO game as a function of the initial terminal-based game. In this embodiment, each play of the terminal-based game consisted of a selection of six numbers from the defined field of numbers 1 to 90. For any individual play purchased by the player, one matching number results in a base prize of one free ticket, and also entitles the player to one HI-LO guess in the subsequent interactive-based game component. The base prize amounts for matching two, three, four, five, and six numbers is also indicated, as well as the corresponding number of HI-LO guesses the player is entitled to. In this HI-LO game, the lottery system randomly generates a sequence of numbers within a specified range, with the total numbers in the sequence being one more than the number of player guesses. For example, for a given play, if the player had two matches and is entitled to one HI-LO guess, than the system generates a sequence of two random numbers.

The first number in the HI-LO sequence is revealed to the player via a display device at the remote access site 16. The player then predicts whether the next number in the sequence is higher (HI) or lower (LO) than the displayed number. The player inputs his guess via an input device, such as a keyboard, at the remote access site 16. The player's guess is recorded by the system and the next number in the sequence is revealed to the player. After the last sequence number is revealed, the player's prize is computed and displayed to the player via the display device at the access site 16. For example, if the player was entitled to two HI-LO guesses, the game is over after the third random sequence number is displayed to the player. The lottery system records that the play has occurred and that a prize has been awarded, or that no prize applies. This process repeats for each play authorized by the access code and indicated on the player's receipt ticket. For example, in the lottery ticket 26 illustrated in FIG. 2, the player had matches in two of the plays, and thus is entitled to two plays in the interactive-based component of the game.

The prizes awarded in the HI-LO game may vary, and may include a wagering component. For example, in the award scheme illustrated in FIG. 4, for any play with multiple guesses, the award amount may be a function of the base prize amount. For instance, the base prize amount awarded for the terminal-based component may be multiplied by two (or any other number) for each correct guess and divided by two for each incorrect guess. As illustrated in the chart in FIG. 4, this scheme may result in the player receiving a minimum prize that is less than the base prize awarded for the terminal-based game component. Referring to the chart, the minimum prize column reflects that the player was wrong on each of the HI-LO guesses, whereas the maximum prize column reflects the award if the player is correct on each of the HI-LO guesses. The interactive-game component may provide the player with the option of not proceeding with the game, or terminating the game at less than the designated number of HI-LO guesses so that the player can preserve any award amount. For example, if the player had five initial matches in the terminal-based game component, and is entitled to three HI-LO guesses in the interactive-based game component, the player may opt not to play the HI-LO game. The system provides the player with this option via the display device and records whether or not the player has elected the option. In an alternative embodiment, the player may be entitled to terminate the game after one guess, or two guesses, and so forth.

Either after completion of the game, or early termination of the game, the player is provided with a status of the outcome of the game, and with instructions on how to collect any prize. The system may provide the player with the capability to print a receipt ticket or slip indicating the award amount, with the player being able to present the slip to a payout location established by the game administrator. Security precautions would obviously be taken to ensure that the slip is authentic. The system may also assign the player with an individual file that can be accessed by the player at a later time with the access code provided to the player. This file may contain individual payout amounts, game history, and so forth related to the player, and also reflect whether any payout amounts have been collected by the player. Any manner of information file is within the scope and spirit of the invention.

Figure 5:
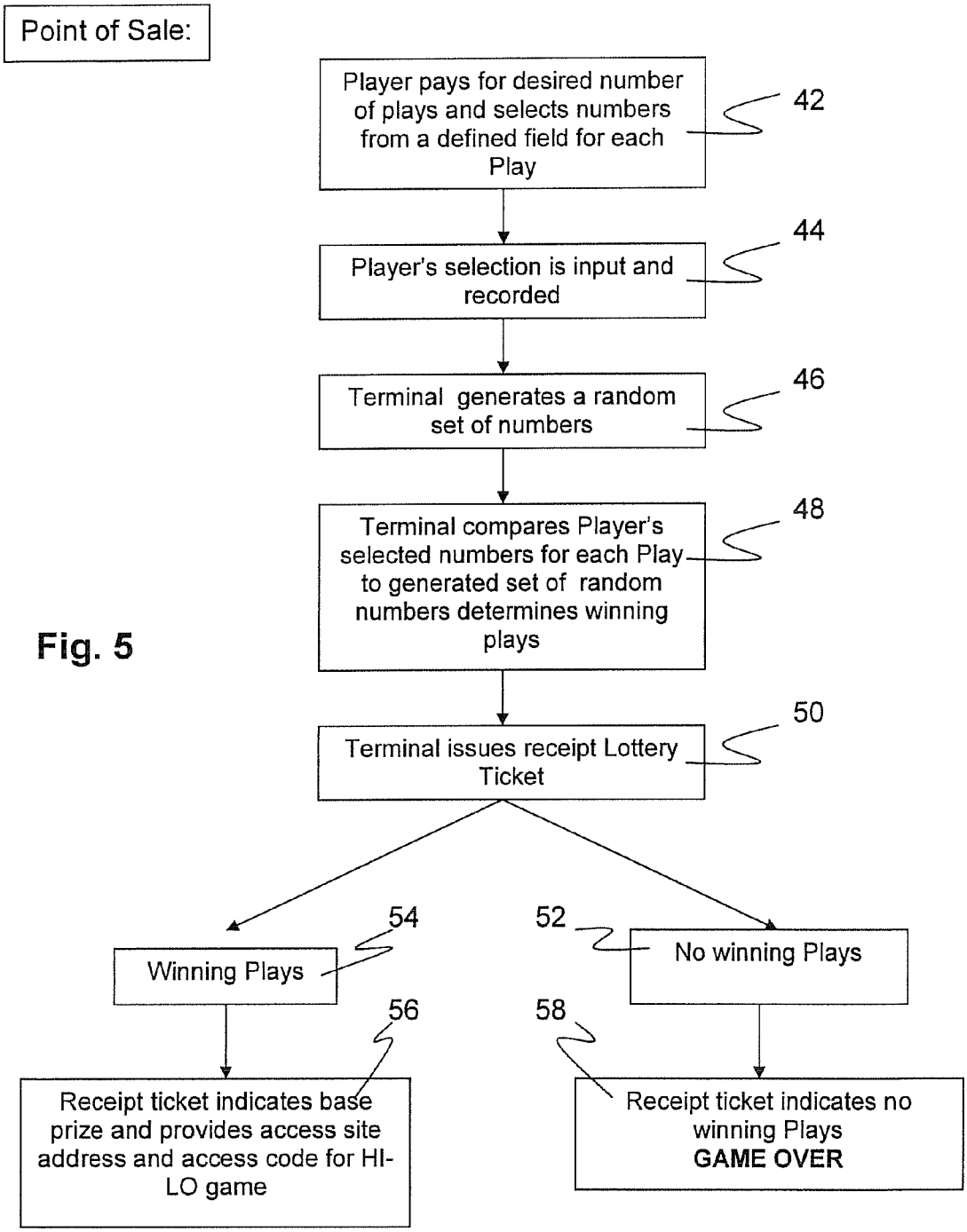
FIG. 5 is a flow chart of an embodiment of the point of sale or terminal based component of the game according to the invention.

FIG. 5 is a flow chart of an embodiment of a methodology and associated system for conducting the point of sale or lottery terminal-based component of the game. In step 42, a player pays for a desired number of plays. For each play, the player selects the appropriate set of numbers from a defined field. At step 44, the player's selection for each play is input and recorded. At step 46, the point of sale terminal generates a random set of numbers from the defined field. At step 48, the player's selected numbers for each play are compared to the set of random numbers generated by the lottery system and any matches are recorded for each play. At step 50, the player is issued a receipt lottery ticket indicating the outcome of the game. For any play with at least one match (step 54), the lottery ticket indicates a base prize and provides the player with an access site address and access code for the subsequent interactive based game, such as the HI-LO game discussed above. If no matches are found for any play (step 52), the receipt lottery ticket indicates that no winning plays resulted and that the game is over.

Figure 6:
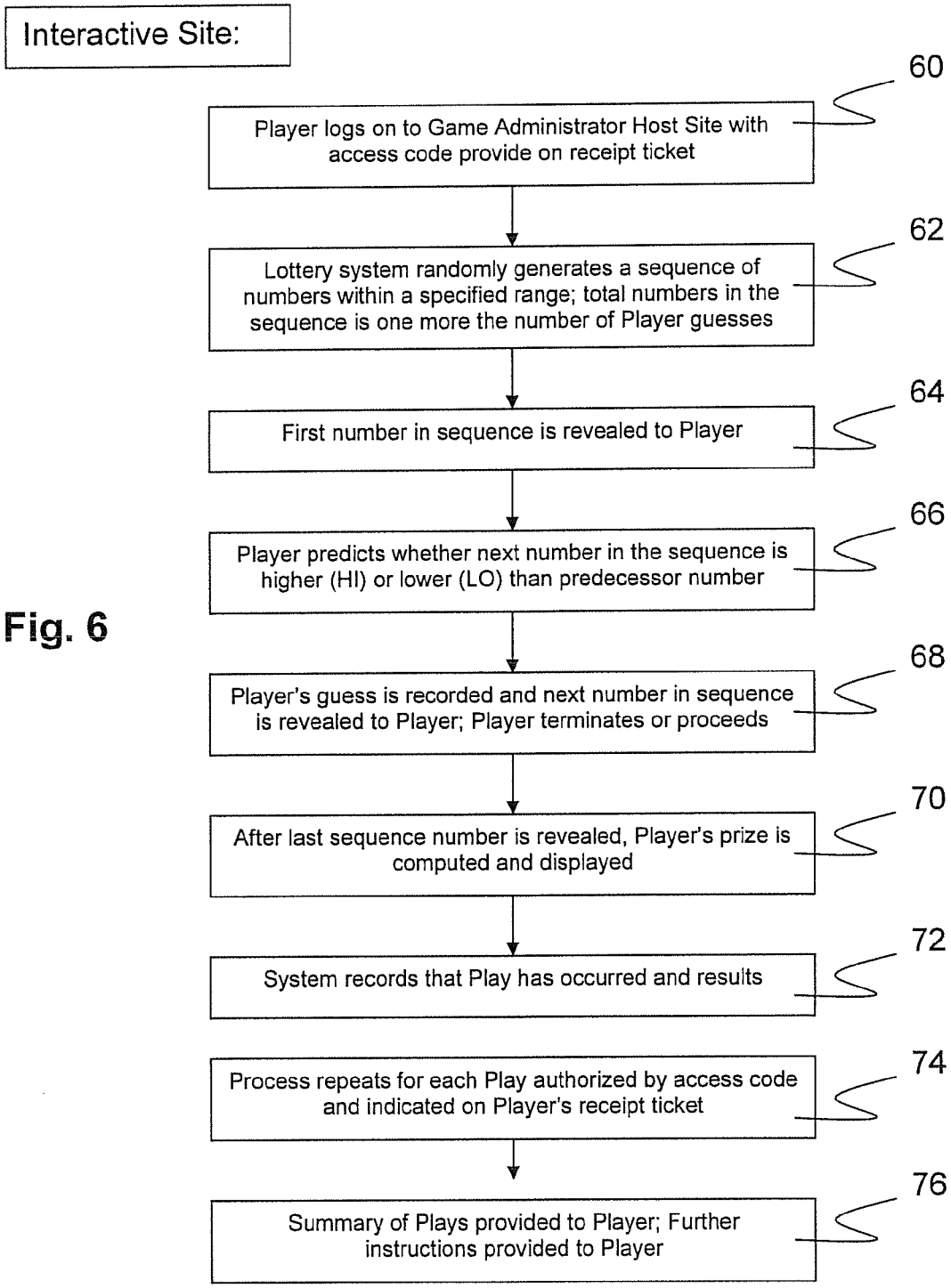
FIG. 6 is a flow chart of an embodiment of an interactive game component in accordance with aspects of the invention.

FIG. 6 is a flow chart applicable to a HI-LO version of an interactive-based game component, as discussed above. At step 60, the player logs onto the game administrator host site with the access code and address provided on the receipt lottery ticket issued at step 56 (FIG. 5). After instructional information is provided to the player, the lottery system randomly generates a sequence of numbers within a specified range in step 62. The total numbers in the sequence is one more than the number of guesses the player is entitled to, as discussed above. In step 64, the first number in the sequence is revealed to the player. In step 66, the player predicts whether the next number in the randomly generated sequence is higher or lower than the revealed number (predecessor number). In step 68, the player's guess is recorded and the next number in the sequence is then revealed to the player. It should be appreciated that, at this point, the player is aware of whether his first guess was correct or not. As discussed above, the player may be provided the option at this point to terminate the game or to proceed to a next guess. After the last sequence number is revealed, or the player terminates the game early, the player's prize is computed and displayed at step 70. At step 72, the lottery system records that the interactive-based component for the winning play from the initial terminal-based component has occurred, as well as any prize awarded. At step 74, the process repeats for each winning play authorized by the access code and indicated on the player's receipt lottery ticket. At step 76, the system provides to the player a summary of any and all plays, including the amount of any prize awarded for each play and further instructions as to collection of the prize amount. Various other options may be instituted at this point, such as providing the player with the option to establish a personal file that may be accessed at a later time. This file may contain any information related to the player's game history, award amounts, and so forth.

It should be understood that the process steps indicated in FIGS. 5 and 6 need not take place in the exact order indicated. Certain steps may be done before others, or combined with other steps. Aspects of the methodology may be done in parallel, and so forth.

It should also be readily appreciated by those skilled in the art that modifications and variations may be made to the embodiments of the system and methodology described herein without departing from the scope and spirit of the invention.

What is claimed is:

1. A method for implementing a dual-component lottery game having a terminal-based game component and an interactive-based game component, comprising:

at a lottery terminal, receiving a player's wager and selection of characters from a defined field of the characters for a play in a lottery terminal-based game;

randomly generating a set of characters from the defined field of characters, and comparing the player's selected characters to the randomly generated set, and determining if the player is a winner as a function of a number of matches between the player's selected characters and the randomly generated set;

displaying the results of the terminal-based game to the player at the lottery terminal, including any base prize award to the player in the terminal-based game;

providing indication to the player as to whether their play in the terminal-based game qualifies for entry into a subsequent interactive-based game, and providing to the player information to access the interactive-based game; and subsequently interactively interfacing with the player for play of the interactive-based game, wherein the player's participation and potential prize award in the interactive-based game is dictated by the results of the terminal-based game such that an amount of player participation by the player in the interactive-based game is determined by the results of the terminal-based game, wherein the player qualifies for entry into the interactive-based game based on a minimum number of matches in the terminal-based game, wherein the number of matches in the terminal-based game dictates the number of plays in the interactive-based game.

2. The method of claim 1, wherein the player is issued a game ticket at the lottery terminal that indicates the results of the terminal-based game and the indication of the player's qualification for the interactive-based game, and associated information for accessing the interactive-based game.

3. The method of claim 1, wherein the prize award for multiple plays in the interactive-based game increases for each successful play of the interactive-based game.

4. The method of claim 3, wherein the prize award in the interactive-based game is decreased for unsuccessful plays of the interactive-based game.

5. The method of claim 3, wherein the player has the option not to play the interactive-based game, or to terminate the interactive-based game prior to all of their eligible plays in the interactive-based game.

6. The method of claim 1, wherein the prize award in the interactive-based game is a function of a player's wager of the base prize award from the terminal-based game, such that the player may win a total amount in the terminal-based game and interactive-based game that is greater than or less than the base prize award.

7. The method of claim 6, wherein the number of matches in the terminal-based game dictates the number of plays in the interactive-based game, and the base prize award from the terminal-based game is increased for successful plays of the interactive-based game, and decreased for unsuccessful plays of the interactive-based game.

8. The method of claim 7, wherein the player has the option not to play the interactive-based game, or to terminate the interactive-based game prior to all of their eligible plays in the interactive-based game.

9. The method of claim 1, wherein the interactive-based game comprises a HI-LO game wherein a sequence of numbers is randomly generated within a specified range of numbers, the first number in the sequence is presented to the player, whereby the player wins if they correctly guess whether the next number in the sequence is higher or lower than the preceding number.

10. The method of claim 9, wherein the number of plays of the HI-LO game is a function of the number of matches from the terminal-based lottery game.

11. The method of claim 10, wherein the number of numbers in the randomly generated sequence is determined by the number of matches from the terminal-based lottery game.

12. A system configured for implementing a dual-component lottery game having a terminal-based game component and an interactive-based game component, comprising:

a plurality of lottery terminals, each said terminal configured for receipt of a player's wager and selection of game characters from a defined field of the characters for a play in a lottery terminal-based game;

said lottery terminals configured to randomly generate a set of characters from the defined field of characters, compare the player's selected characters to the randomly generated set, and determining if the player is a winner in the terminal-based game as a function of a number of matches between the player's selected characters and the randomly generated set;

said lottery terminals further configured to provide the results of the terminal-based game to the player at said lottery terminal, including any base prize award to the player in the terminal-based game;

a central host computer, said lottery terminals networked with said host computer, said host computer configured to execute and control administration of the dual-component lottery game via said lottery terminals;

a plurality of interactive access sites networked with said central host computer to provide access to winners of the terminal-based game to a subsequent interactive-based game implemented by said host computer; and wherein the player's participation and potential prize award in the interactive-based game is dictated by the results of the terminal-based game such that an amount of player participation by the player in the interactive-based game is determined by the results of the terminal-based game, wherein the player qualifies for entry into the interactive-based game based on a minimum number of matches in the terminal-based game, with the number of matches in the terminal-based game dictating the number of plays in the interactive-based game.

13. The system of claim 12, wherein said lottery terminals are configured to issue a game ticket that indicates the results of the terminal-based game and the indication of the player's qualification for the interactive-based game.

14. The system of claim 13, wherein said lottery terminals further generate an access code for the player's subsequent participation in the interactive-based game.

15. The system of claim 12, wherein the prize award for multiple plays in the interactive-based game increases for each successful play of the interactive-based game.

16. The system of claim 15, wherein the prize award in the interactive-based game is decreased for unsuccessful plays of the interactive-based game.

17. The system of claim 16, wherein said interactive access sites provide the player the option not to play the interactive-based game, or to terminate the interactive-based game prior to all of their eligible plays in the interactive-based game.

18. The system of claim 12, wherein said interactive access sites are configured to accept a player's wager in the interactive-based game based on the base prize award from the terminal-based game, such that the player may win a total amount in the terminal-based and interactive-based games that is greater than or less than the base prize award.

19. The system of claim 18, wherein the number of matches in the terminal-based game dictates the number of plays in the interactive-based game, and the base prize award from the terminal-based game is increased for successful plays of the interactive-based game, and decreased for unsuccessful plays of the interactive-based game.

20. The system of claim 18, wherein said interactive access sites are configured to provide the player with the option not to play the interactive-based game, or to terminate the interactive-based game prior to all of their eligible plays in the interactive-based game.

21. The system of claim 12, wherein the interactive-based game comprises a HI-LO game wherein a sequence of numbers is randomly generated by said host computer within a specified range of numbers, the first number in the sequence is presented to the player, whereby the player wins if they correctly guess via said interactive access sites whether the next number in the sequence is higher or lower than the preceding number.

22. The system of claim 21, wherein the number of plays of the HI-LO game is a function of the number of matches from the terminal-based lottery game.

23. The system of claim 21, wherein the number of numbers in the randomly generated sequence is determined by the number of matches from the terminal-based lottery game.

* * * * *